United States Patent [19]

Supik

[11] Patent Number: 4,732,292

[45] Date of Patent: Mar. 22, 1988

[54] FLEXIBLE BOTTOM PROFILE FOR DRAWN AND IRONED BEVERAGE CAN

[75] Inventor: Helmuth Supik, Sorstedt, Fed. Rep. of Germany

[73] Assignee: Schmalbach-Lubeca GmbH, Braunschweig, Fed. Rep. of Germany

[21] Appl. No.: 260,558

[22] Filed: May 5, 1981

Related U.S. Application Data

[63] Continuation-in-part of Ser. No. 49,249, Jun. 18, 1979, abandoned.

[30] Foreign Application Priority Data

Jun. 16, 1978 [DE] Fed. Rep. of Germany ..... 2826422

[51] Int. Cl.[4] ..... B65D 1/16; B65D 1/42

[52] U.S. Cl. ..... 220/70; 220/1 BC; 220/66; 220/72; 220/457; 220/458

[58] Field of Search ..... 220/66, 70, 1 BC, 72, 220/457, 458; D9/370

[56] References Cited

U.S. PATENT DOCUMENTS

| | | | |
|---|---|---|---|
| 91,754 | 6/1869 | Lawrence | 220/70 |
| D. 254,957 | 5/1980 | Campbell et al. | D9/370 |
| D. 256,333 | 8/1980 | Campbell et al. | D9/370 |
| D. 257,463 | 10/1980 | Campbell et al. | D9/370 |
| 998,490 | 7/1911 | Fitch | 220/70 X |
| 1,762,903 | 6/1930 | Werder | 220/70 X |
| 2,379,680 | 7/1945 | Burdick | D9/370 |
| 2,971,671 | 2/1961 | Shakman | 220/66 |
| 3,043,461 | 7/1962 | Glassco | 220/70 X |
| 3,096,900 | 7/1963 | Breneman | 220/70 X |
| 3,291,363 | 12/1966 | McCormick et al. | 220/70 X |
| 3,369,694 | 2/1968 | Manser et al. | 220/67 |
| 3,572,271 | 3/1971 | Fraze | 72/352 |
| 3,603,275 | 9/1971 | Eickenhorst et al. | 72/352 |
| 3,904,069 | 9/1975 | Toukmanian | 220/70 X |
| 3,912,109 | 10/1975 | Essex, Jr. et al. | 220/66 |
| 3,927,790 | 12/1975 | Chase | 220/72 |
| 3,979,009 | 9/1976 | Walker | 220/70 X |
| 4,048,934 | 9/1977 | Wallace | 220/70 X |
| 4,125,632 | 11/1978 | Vosti et al. | 220/70 X |
| 4,175,670 | 11/1979 | Reynolds et al. | 220/70 |

FOREIGN PATENT DOCUMENTS

| | | | |
|---|---|---|---|
| 2701827 | 7/1978 | Fed. Rep. of Germany | 220/70 |
| 2308554 | 11/1976 | France | 220/70 |

*Primary Examiner*—Allan N. Shoap
*Attorney, Agent, or Firm*—Charles E. Brown

[57] ABSTRACT

A bottom profile for a can in which a center dome-shaped portion is provided circumscribed by an annulus which may be flat or formed with a concentric bead or provided with various shaped depressions, the annulus merging at its outer edge with the cover edge of a frustoconical portion which at its upper edge merges into the can body wall, the inner edge of the annulus merging with the marginal edge portion of the dome and the depressions defining radial arrays of ribs or strength imparting configurations of different shapes.

5 Claims, 17 Drawing Figures

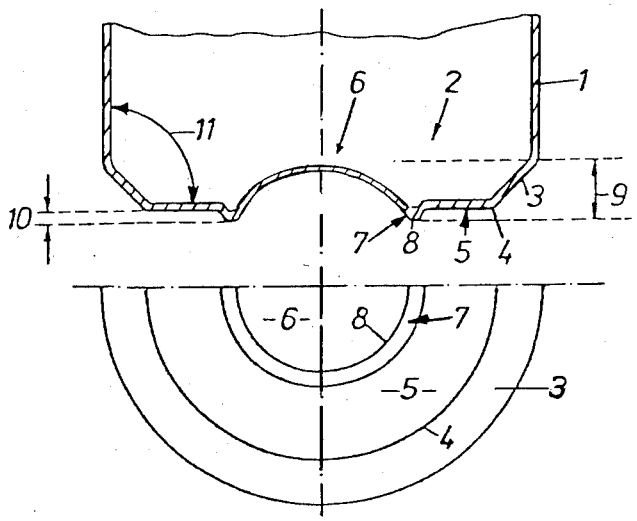
FIG. 1
FIG. 2
FIG. 3
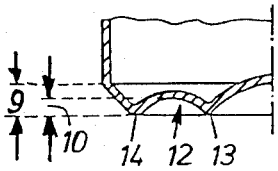
FIG. 5
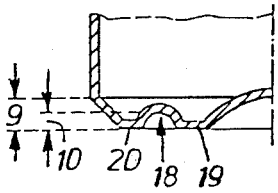
FIG. 7
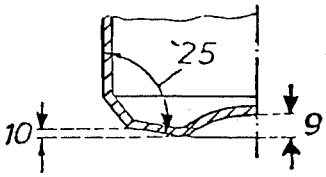
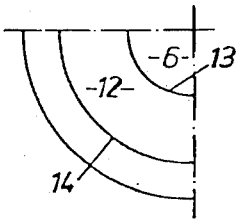
FIG. 4
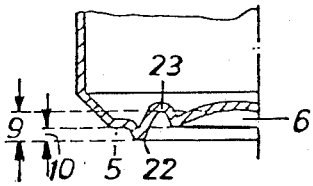
FIG. 6

Fig. 8
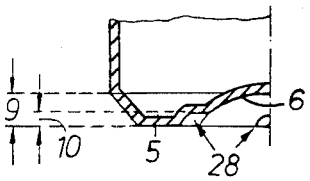
Fig. 10
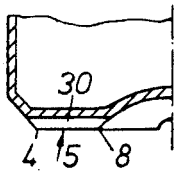
Fig. 12
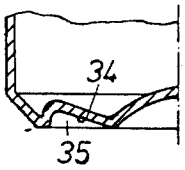
Fig. 9
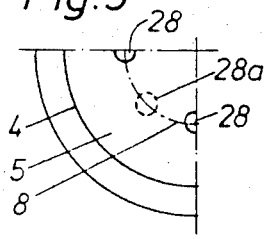
Fig. 11
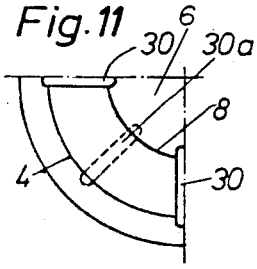
Fig. 13
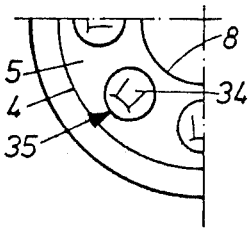
Fig. 14
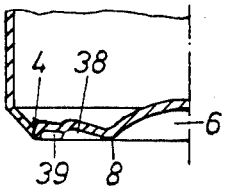
Fig. 16
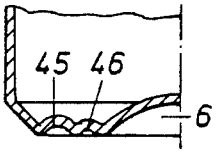
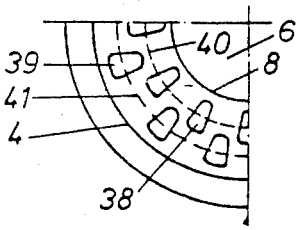
Fig. 15
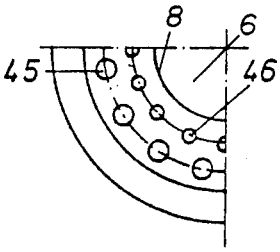
Fig. 17

FLEXIBLE BOTTOM PROFILE FOR DRAWN AND IRONED BEVERAGE CAN

This application is a continuation-in-part of my copending application Ser. No. 49,249, filed June 18, 1979, now abandoned.

This invention relates to a can with a dome-shaped (calotte) bottom outwardly or inwardly offset center portion circumscribed by an annular bead between the dome and the can body.

Cans in one piece of a similar kind are known as disclosed in U.S. Pat. Nos. 3,369,694, 3,904,069 and 3,409,167 which show various types of expandable bottoms. The disadvantages or problems in these known cans are that:

a. The application of the profiles disclosed lead to a considerable difference in height between the closed and the empty can, on the one hand, and the conventional can with a large rigid calotte (cup) on the other. This has as a consequence costly conveyor changes in the installations at the customer.

b. Furthermore, in the conventional can with the large, rigid calotte, it is known that the adhesion of lacquer or coating on the interior is worse where the slightest deformation of the sheet metal takes place, namely in the area of the bottom profile. Such profiles as disclosed in the above references are submitted to a lesser deformation than that of the instant invention.

c. When the containers with the prior art profiles are pressurized rolling out of the ends which delimits the small calotte from the flat portion can occur. The thereby caused embrittlement of the lacquer may cause a premature defect of the can.

d. The relative afterflow of the sheet material from the body into the area of the bottom is greater in the disclosed profiles than in case of the conventional large rigid calotte.

e. The resulting value of the unit pressure upon the small calotte is smaller in case of the known profile than the pressure upon the conventional calotte, but the sheet metal in the area of the small inner calotte is unnecessarily thick.

These problems are solved by the features of the present invention. In case of cold-drawn cans it is caused by deformations in the annular bottom area that in stretch-drawing and in forming the bottom deformations less of the material flows from the body area into the bottom area and the calotte shaped section is equally stretch-drawn by a reduction of the thickness of its sheet metal, while in the known cans only a deformation of the area of the calotte is basically obtained. By the greater stretching of the area of the calotte, a considerably better adhesion of the lacquer layers on the inner surface of the can is obtained in the bottom area because of the greater roughness caused by the stretching operation and the larger area thereof.

A to-the-outside circular, or even better an inward projecting bead in the bottom section has proven to be advantageous. This bead borders advantageously directly with the edge of the calotte. The bead needs to project only slightly from the plane, in which the outer edge of the annular bottom section is placed, to the outside or to the inside. A height of the bead of less than 2 mm, preferably a height between 0.2 and 0.5 mm suffices. In the latter case, the stability of the empty can above all is also improved.

In a crown-shaped arrangement of several deformations in the annular bottom section these deformations project throughout into the inside of the body of the can. The deformations can then penetrate at least into the inner delimiting edge of the annular bottom section, so that they penetrate slightly even into the calotte area.

It has also proven to be of further advantage to provide several blank (cup) like impressions dividedly arranged in the annular bottom section on two concentric partial circles.

The invention is best explained on several examples of embodiments with the aid of schematic drawings wherein:

FIG. 1 is a vertical sectional view of the lower portion of a can made according to the invention;

FIG. 2 is a fragmentary bottom view of the can shown in FIG. 1;

FIGS. 3, 5, 6, 7, 8, 10, 12, 14 and 16 are fragmentary schematic vertical sectional views of various embodiments of the invention, and FIGS. 4, 9, 11, 13, 15, and 17 are fragmentary bottom views of the cans of FIGS. 3, 8, 10, 12, 14 and 16, respectively.

The can shown in FIGS. 1 and 2 has a basically cylindrical can body 1 which at its lower end is integral with a bottom. The transition between the body and the bottom can be made by a rounding or curve, preferably, however, by a beveling in the shape of a truncated cone 3, as shown in FIG. 1. The bottom proper consists of two sections, namely of a central section 6 projecting into the inside of the body 1 and being of calotte or dome shape, and surrounding the central section 6 is an intermediate bottom section 5 that is basically radially extending. The radial width of the annular section 5 of the bottom 2 is radially limited at the inside by the edge 8 to the calotte shaped portion 6 and at the outside by the edge 4 of the transitional section 3. The calotte 6 is visibly thinner than the annular bottom section 5.

As far as heretofore described, the design of the bottom corresponds basically to the design of the bottom of the container accordding to FIG. 5 of U.S. Pat. No. 3,369,694.

The annular section 5 has, however, additional deformations. In the example according to FIGS. 1 and 2, this deformation consists of an annular bead 7 which has a radially inside flange forming a direct continuation of the calotte section 6. The bead 7 projects axially downwardly although it may slope toward the inside (not illustrated). The axial projection of the crest of the bead 7 relative to the annular section 5 from the outward delimiting edge 4 is identified by the numeral 10 and is less than 2 mm in a customary size beverage can made of metal. The axial distance 10 is preferably from about 0.2 to 0.4 mm.

The angle between the annular section 5 and the can body 1 is identified by the numeral 11 in FIG. 1 and the numeral 25 in FIG. 7. This angle can be larger than 90° (FIG. 7) in a preferred example of embodiment, but also smaller than 90°. Due to the preferred inclination of the annular section 5, the radial inner delimiting edge of the annular section as related to the outer delimiting edge 4 is spaced downwardly.

The axial distance between the highest point of the calotte shaped section and of the deepest point of the annular bottom section is represented by the numeral 9. It is recognized that this axial height 9 is comparably small. A better stability of the empty container over the prior art is nevertheless provided as was demonstrated by thorough tests.

In the example of embodiment according to FIGS. 3 and 4, there is a flat bead 12 which projects into the interior of the container and spans the entire width of the annular section between the delimiting edges 13 and 14. The axial depth of deformation of the bead 12 is designated by the numeral 10.

In the exmaple of embodiment according to FIG. 5, the width of the annular bead 18 is limited to a fraction of the width of the annular section whereby on both sides of the bead there remain flat sections 19 and 20 of the annular section.

In the example of embodiment according to FIG. 6, there is an axially downwardly projecting bead 22 combined with a bead 23 projecting axially into the interior of the can. The bead 23 is directly adjacent to the calotte area 6. In a preferred example of embodiment, the bead 23 can be omitted. Beside the outwardly projecting bead 22, there is still a plane or flat annular area of the bottom section 5 left. While in the heretofore described examples of embodiments the deformations are made annularly, it is equally feasible to make crown-shaped divided deformations in the annular bottom section 5.

In the example of embodiment according to FIG. 7, radially extending depressions 27 are provided which extend between the edge 13 of the dome 6 and the edge 13 and the edge 14 and of the truncated portion 3. The depressions widthwise (circumferentially of the can) are of the order of those shown at 30 in FIG. 11.

In the example of embodiment according to FIGS. 8 and 9, there are at least four circumferentially spaced, equally cup-shaped depressions or dimples 28 provided in the bottom section 5. The depressions extend into the interior of the body of the can. The dimples 28 intersect the radially inner limiting edge of the annular bottom section 5 as clearly shown in FIGS. 8 and 9. Instead of four, a greater number of cup-shaped deformations can be provided as indicated in dash lines at 28*a*.

In the example of embodiment according to FIGS. 10 and 11, the cup-shaped depressions of the embodiment of FIGS. 8 and 9 are elongated in a radial direction to extend over the entire width of the annular section 5 so that the outside placed ends of the depressions 30 or 30*a* penetrate into the frustoconical transitional section 3.

In the example of FIGS. 12 and 13, there are cup-shaped depressions 35 which have a basically radial extent approximately equal to the radial width of the annular section 5. The cup-shaped depressions 35 are appropriately limited on the radially outwardly directed side and to both circumferential sides by steep walls, in the bottom area and in the radially inner area. However, a continuous flat wall 34 is provided.

In the examples of FIGS. 14 and 15, the depressions 38, 39 are arranged in crown shape and are divided into two different pitch circles 40, 41. In the example of embodiment according to FIGS. 14 and 15, the deformations are longer in radial direction than in circumferential direction. They are spaced in the circumferential direction by a gap whereby adjacent depressions 38, 39 in the circumferential direction are assigned to different pitch circles overlap in radial direction. A joint line, concentric with the can axis is eliminated. The bottom thus has an extraordinary stiffness, so that the deformations are kept within limits. Further, the calotte area being subject to only a slight expansion, takes only a slight portion of the usable volume.

In the embodiment of FIGS. 16 and 17, the two different diameter pitch circles have formed thereon circular depressions 45, 46. The depressions 45 are of larger diameter than the depressions 46.

The above-described cans are all in the as formed non-pressurized state. That is, the cans have not been filled with any product and have not been internally pressurized by any gaseous pressure.

I claim:

1. A can for pressurized packaged products, said can comprising a cylincrical body and an integral bottom comprising a tapered peripheral portion of truncated cone-shape extending downwardly from said body, a calotte-shaped central portion projecting into the can interior, and an intermediate ring-shaped portion between said peripheral and central portions, said ring-shaped portion having a plurality of equidistantly circumferentially spaced cup-shaped dimples being defined in two circumferential directions by two walls connected in a radial outward direction by a steep wall and in a radial inward direction by a relatively shallower wall, said dimples having centers located in staggered arrangement on two concentric circles.

2. A can for pressurized packaged products, said can comprising a cylindrical body and an integral bottom, said bottom including an outer transition section of inverted frustoconical shape joined to said body by a radius, a generally planar intermediate ring-shaped section, and a central calotte-shaped section projecting into the interior of the can, said can bottom being characterized by stiffening deformation means in said intermediate ring-shaped section, said deformation means comprising a plurality of dimples arranged approximately equidistant on the circumference and projecting axially into the interior of said can body, said dimples 3. A can in accordance with claim 2 wherein said dimples situated on one of said two circles are different from said dimples situated on the other of said two circles.

4. A can in accordance with claim 2 wherein circumferentially adjacent ones of said dimples are in radially overlapping relation in a circumferential direction.

5. A can in accordance with claim 2 wherein said dimples situated on one of said two circles are different in size from said dimples situated on the other of said two circles.

* * * * *